United States Patent [19]

Nakahara et al.

[11] Patent Number: 4,516,537

[45] Date of Patent: May 14, 1985

[54] VARIABLE COMPRESSION SYSTEM FOR INTERNAL COMBUSTION ENGINES

[75] Inventors: Mitsuharu Nakahara; Tomio Ishida; Norifumi Honjo; Yoshitaka Yoshida, all of Ikeda, Japan

[73] Assignee: Daihatsu Motor Company, Osaka, Japan

[21] Appl. No.: 476,548

[22] Filed: Mar. 18, 1983

[51] Int. Cl.[3] ..... F02B 75/04

[52] U.S. Cl. ..... 123/48 AA; 123/78 AA

[58] Field of Search ..... 123/48 R, 48 A, 48 AA, 123/48 D, 78 R, 78 A, 78 AA, 78 D

[56] References Cited

U.S. PATENT DOCUMENTS

| | | | |
|---|---|---|---|
| Re. 18,595 | 9/1932 | Wilson | 123/48 AA |
| 830,099 | 9/1906 | Packard | 123/48 A |
| 2,040,652 | 5/1936 | Gaty | 123/48 AA |
| 2,163,015 | 6/1939 | Wagner | 123/48 AA |
| 2,769,433 | 11/1956 | Humphreys | 123/48 AA |
| 2,883,974 | 4/1959 | Heising | 123/48 AA |
| 2,970,581 | 2/1961 | Georges | 123/48 A |
| 4,187,808 | 2/1980 | Audoux | 123/48 AA |

FOREIGN PATENT DOCUMENTS 56-88926 7/1981 Japan .

OTHER PUBLICATIONS

Paul et al.; "Humphreys Engine Provides Variable Clearance Volume"; SAE Journal, Aug. 1952; pp. 56–60.

*Primary Examiner*—Craig R. Feinberg

*Attorney, Agent, or Firm*—Birch, Stewart, Kolasch & Birch

[57] ABSTRACT

A variable compression system for internal combustion engines whose compression ratio is varied by hydraulic regulation of back and forth movement of a sub-piston slidably mounted within a sub-cylinder communicated with a combustion chamber, comprising a control valve for controlling pressure oil supply to a pressure oil chamber formed on a back face of the sub-piston and communicated, via passages, with a spill port for pressure oil release which is formed in a hollow, reciprocative member cooperatively connected to the sub-piston and relatively movably mounting a spilling regulation member thereon.

15 Claims, 15 Drawing Figures

VARIABLE COMPRESSION SYSTEM FOR INTERNAL COMBUSTION ENGINES

BACKGROUND AND SUMMARY OF THE INVENTION

The present invention relates to a variable compression system for internal combustion engines, and more particularly to the system wherein compression ratio of the engine can be varied during its periods of operation by means of hydraulic pressure.

In an internal combustion engine, intended enhancement of the power output and reduction of the specific fuel consumption may be achieved by increasing the compression ratio. However, the increase in the compression ratio disadvantageously invites occurrence of knocking in the heavy load zone and/or the low speed zone of the engine. Thus, in the conventional internal combustion engine whose compression ratio is constant, its practicable compression ratio must be set up inevitably at such a low level as not to cause knocking in the heavy load zone and/or the low speed zone. This results in that it is impossible to output a sufficient power and reduce the specific fuel comsumption in the light load zone and/or the high speed zone.

Several attempts to vary the compression ratio of the internal combustion engine in operation have been proposed for example in U.S. Pat. Nos. 2,040,652 to Gaty, 2,970,581 to Georges and 2,163,015 to Wagner. The systems as disclosed in the U.S. Pat. Nos. 2,040,652 and 2,970,581 are designed to conduct the variation of the compression ratio by back and forth movement of a diaphragm (U.S. Pat. No. 2,404,652) or a sub-piston (U.S. Pat. No. 2,970,581) associated with a combustion chamber, in which the diaphragm (or the sub-piston) is moved toward or away from the combustion chamber by regulating the flow of pressure oil into and out of a rear chamber provided at the back (upper side) of the diaphragm (or the sub-piston) in accordance with variable loads upon the engine. According to this prior technique arrangement, however, due to an intense pressure (approximetely 50 kg/cm$^2$ in the case of a gasoline engine) produced by explosion of the fuel-air mixture in the combustion chamber, the diaphragm (or the sub-piston) is disadvantageously forced to move axially rearwardly (upwardly) thereby to produce an excessively high pressure in the aforesaid rear chamber, which causes the pressure oil to flow back from the rear chamber into an oil pressure regulator and further into a hydraulic pump through conduits for supplying the pressure oil in accordance with the variable loads on the engine. For this reason, the regulator and the conduits should have strength enough to endure the intense pressure caused by the explosion, and also the hydraulic pump should have the pumping capacity enough to surpass the back-flow pressure of the oil, which inevitably invites a disadvantageously large dimension and heavy weight of the system. Besides, these prior art systems will not work as expected because the regulation of the compression ratio is accompanied by an intolerably large error under the intense explosion pressure.

According to the system as disclosed in the referred U.S. Pat. No. 2,163,015, the compression ratio is varied by a cam mechanism connected to a sub-piston. The cam mechanism includes a cam mounted on a cam shaft which can be driven by a hydraulic cylinder adapted to act in accordance with variable engine speeds. A piston rod is connected at its lower end to a sub-piston reciprocable up and down within a sub-cylinder, and engaged at its upper end with the cam, so that the clearance volume of a combustion chamber can be varied upon movement of the sub-piston. Also in this case, the above described back-flow of the pressure oil occurs under the intense explosion pressure. Thus, this particular system is also subjected to the same or similar disadvantages as those inherent to the system as disclosed in the above referred in U.S. Pat. Nos. 2,040,652, and 2,970,581.

In order to solve the above discussed problem derived from the undesirable back-flow of the actuating oil (pressure oil), an attempt has been made as disclosed in Japanese patent application Laid-open No. 88926/81. The arrangement proposed therein comprises a hydraulic cylinder, a plunger disposed within the hydraulic cylinder so as to be coaxial and engageable with a piston rod connected at lower end to a sub-piston for varying the compression ratio, a change-over valve provided in a pressure oil conduit connected to the hydraulic cylinder for switching over its positions from feed position to release position and vice versa, the change-over valve being so arranged that it takes its feed position in the light load zone and/or the high speed zone of the engine, for supplying the pressure oil into the hydraulic cylinder thereby to move the sub-piston toward the combustion chamber, while in the heavy load zone and/or the low speed zone of the engine, it takes its release position for releasing the pressure oil from the hydraulic cylinder into atmosphere thereby to move the sub-piston away from the combustion chamber, and a check valve provided in a passageway extending from the changeover valve to the hydraulic cylinder for oneway flow to the hydraulic cylinder, so that pressure rise in the hydraulic cylinder, due to the expansion in the combustion chamber, does not invite the undesirable back-flow of the pressure-oil into the hydraulic units located upstream of the check valve.

According to this prior art system, because the changeover valve is so arranged that, at a certain critical value of the enginge load or the engine speed, it takes the alternative of its feed position for supplying the pressure oil to the hydraulic cylinder, or its release position for releasing the pressure oil from the hydraulic cylinder, the reglation for the back and forth movement of the sub-piston, and hence, for the compression ratio, is performed in a radical manner where the compression ratio is stepped from a high ratio phase to a low ratio phase or vice versa, at a certain critical valve of the engine load or the engine speed. In other words, the compression ratio cannot be varied steplessly in propotion to values of the engine load or the engine speed. Thus, this prior art system is subjected to such particular disadvantages that not only frequent occurrences of knocking but also considerable fluctuations of the engine torques are brought about by the radical variation in the compression ratio.

Further, in this case, the following disadvantages are invited by its specific construction that the piston rod of the sub-piston is operatively engaged with the plunger of the hydraulic cylinder. The first disadvantage is that the diameter of the piston rod must be large enough to resist against such a considerable compressive force exerted thereon caused by an intense explosion pressure produced in the combustion chamber. A second disadvantage is that undesirable vibrations and/or noises are produced by collisions of the piston rod against the plunger of the hydraulic cylinder.

It is, therefore, an object of the present invention to provide an improver variable compression system for internal combustion engines, in which the above-discussed disadvantages, inherent to the conventional systems or devices, can be eliminated.

Another object of the invention is to provide an improved system for controlling the compression ratio, so arranged as to prevent the pressure oil (actuating oil) from flowing back to its pressure oil source, regardless of intense oil pressure produced at the back side of a sub-piston due to the explosion conducted in a combustion chamber.

A further object of the invention is to provide an improved system for controlling the compression ratio, which permits variation of the compression ratio at a low level of hydraulic pressure.

A still further object of the invention is to provide an improved system for controlling the compression ratio, in which variation of the compression ratio can be conducted in a smooth and stepless manner, without fluctuations in the engine torques and occurrences of knocking during variation of the compression ratio.

Yet further object of the invention is to provide an improved system for controlling the compression ratio, in which variation of the compression ratio can be performed automatically or manually by a simple and easy manner with less power, in response to variable operating conditions of the engine, such as engine speeds, engine loads, knocking, ect.

Still a further object of the invention is to provide an improved system for controlling the compression ratio, which is simple in construction, compact in size, light in weight, and operable without increase in vibration and noises.

In accordance with the present invention, there is provided a variable compression system for internal combustion engines of the type that variation of the compression ratio is conducted by hydraulic regulation of back and forth movement of a sub-piston slidably mounted within a sub-cylinder which is communicated with a combustion chamber. The system of the invention comprises: (i) an pressure oil chamber formed on a back face of the sub-piston and pressurized from a pressure source, (ii) a control valve means, such as a check valve, provided in a pressure oil feed passage for checking the pressure oil feed to the pressure oil chamber, (iii) a reciprocative member, for example a stem, which is connected at one end to the sub-piston and has a part projecting out of the sub-cylinder through a closure member mounted to the back end of the sub-cylinder, the reciprocative member having an internal oil passage which is communicated with the pressure oil chamber and also with a through hole, hereinafter referred to as "a spill port", formed in the projecting part of the reciprocative member, for releasing the pressure oil introduced from the pressure oil chamber, and (iv) a spill regulation member relatively movably mounted on the projecting part of the reciprocative member for timely opening or closing the spill port in such a manner that it closes the spill port when the sub-piston moves away from the combustion chamber and opens the same when the sub-piston moves toward the combustion chamber.

In operation of the system according to the present invention, the pressure oil supply to the pressure oil chamber is performed when the spill port is closed by the spilling regulation member and when the check valve in the pressure oil feed passage takes its open position, i.e., when a force for advancing the sub-piston, derived from a pressure of the supplied pressure oil (actuating oil), is greater than a force for retracting the sub-piston, derived from a pressure in the combustion chamber, and more particularly, at the intake stroke or the exhaust stroke, for instance. At the compression stroke or the expansion stroke, on the other hand, where the compression chamber is highly pressurized, the check valve is in its closed position and therefore, an intense pressure increase in the pressure oil chamber, caused by expansion in the combustion chamber, does not invite the back-flow of the actuating oil to such hydraulic units, for example a hydraulic pump, as located at the pressure oil source side.

In such a pressure balanced condition where the spill port is slightly opened to permit continuous release of the actuating oil introduced through the pressure oil feed passage and the pressure oil chamber, the spill regulation member is moved to close the spill port. As soon as the spill port is fully closed, the release of the actuating oil therethrough is terminated, whereby the pressure in the pressure oil chamber at the intake or exhaust stroke rises up to a level of the actuating oil supplying pressure, so that the force for advancing the sub-piston toward the combustion chamber, developed by this increased pressure in the combustion chamber, becomes greater than the force for retracting the sub-piston away from the combustion chamber, resulting in that the sub-piston advances toward the combustion chamber.

When this advancement of the sub-piston proceeds to a certain extent, the spill port is again opened to start the release of the actuating oil. As soon as the released volume of the oil thru the spill port is balanced with the supplied volume of the oil into the pressure oil chamber, the advancement of the sub-piston ends.

As will be observed, the advancement of the sub-piston toward the combustion chamber is governed by supplying the actuating oil into the combustion chamber at the intake or exhaust stroke where the pressure in the pressure oil chamber is low, whereas the retraction of the sub-piston away from the combustion chamber is governed by releasing the actuating oil from the pressure oil chamber via the spill port. Therefore, pressure of the actuating oil to be supplied into the pressure oil chamber need not surpass an intense explosion pressure produced in the combustion chamber, resulting in that the actuating oil may be utilized at a low pressure level. This means that a high capacity hydraulic pump is no longer required for actuating the sub-piston. Further, such low pressure oils, for example lubricating oils for various parts of the engine, or actuating oils for power-steering or automatic transmission, can be utilized as the actuating oil for the system according to the present invention. In the case where the lubricating oil for the engine parts is utilized as the actuating oil in question, a lubricating oil pump may serve also for the actuating oil pump.

Further, the back and forth movement of the sub-piston is governed by controlling the spill regulation member so that the spill port is properly opened or closed, and thus, the compression ratio can be varied in a stepless manner.

When an intense explosion pressure is imposed upon the sub-piston at the expansion stroke, as the check valve in the pressure oil feed passage being in its closed position, the sub-piston is forced to move slightly rearwardly, whereby the spill port is closed to cause a rapid pressure increase in the pressure oil chamber. Thus, the intense explosion pressures imparted upon the sub-piston can be backed up and, at the same time, buffered by compression of the actuating oil in the pressure oil chamber behind the sub-piston. This results in that any increase in vibration and noises is not invited, though the intense explosion pressures are intermittently impacted upon the sub-piston. Further, the spilling regulation member does not move unexpectedly under the explosion pressure, and hence, the compression ratio is maintained substantially at its desired level without fluctuations thereof. In addition, relatively small power is enough to drive the spilling regulation member.

According to the present invention, no thick stem is required since the intense explosion pressure does not act thereupon as a compressive force; no extra hydraulic cylinder is required to move the sub-piston back and forth, such as those inherently provided in the prior art systems as referred to in the forgoing, additionally to the one in which the sub-piston for varying the compression ratio of the engine is mounted; a relatively low capacity hydraulic pump, usually small in size, is sufficient to use for pressurizing the actuating oil for the sub-piston because the oil can be utilized at its low pressure level; and besides, this pump may be dispensed with, in such a particular case where a lubricating oil pump serves for it; all of these features of the invention cooperatively contribute to the simple and compact construction as well as reduction in weight of the system.

The present invention has an additional feature, that an easy and ready engine starting can be attained by retracting the sub-piston, upon stopping the engine, to its rearmost position (best standby position), furthest away from the combustion chamber.

A further feature or aspect of the invention is that deterioration of the pressure oil (actuating oil), caused by the blow-by gas which penetrates through the clearance between the sub-piston and the associated sub-cylinder, can be minimized by provision of the blow-by gas chamber.

A still further feature or aspect of the invention is that the variable compression system herein disclosed is readily applicable to counter-flow type engines and also to multi-cylinder engines, such as for example, two-cylinder engines, three-cylinder engines, four-cylinder engines, and the like.

Yet a further feature or aspect of the invention is that the variable compression system herein disclosed is readily applicable not only to spark-ignition type engines but also to compression-ignition type engines.

Other objects, features and advantages of the present invention will become apparent from the detailed description given hereinafter; it should be understood, however, that the detailed description and specific examples, while indicating preferred embodiments of the invention, are given by way of illustration only, since various changes and modifications within the spirit and scope of the invention will become obvious to those skilled in the art from this detailed description.

DESCRIPTION OF THE PREFERRED EMBODIMENTS

Figure 1:
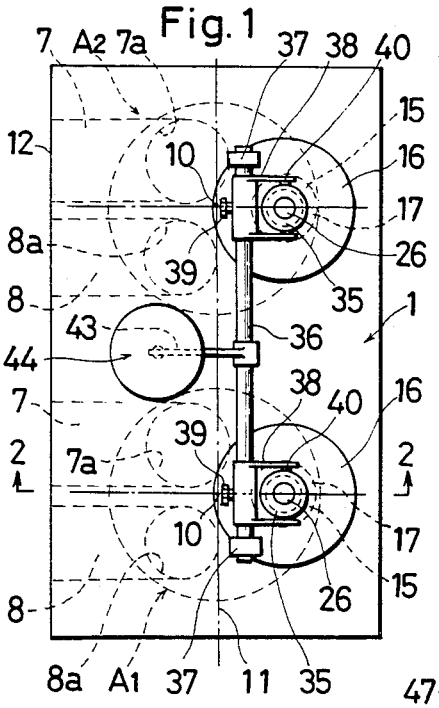
FIG. 1 is a top plan view of a straight-type two-cylinder engine in which a variable compression system for internal combustion engines according to the present invention is incorporated.

Referring now to the accompanying drawings, wherein like reference numerals designate like or corresponding parts throughout the several views, FIGS. 1 thru 8 illustrate a straight-type two-cylinder internal combustion engine 1 equipped with a variable compression system as the first embodiment of the present invention. The engine 1 is illustrated as having a first main cylinder $A_1$ and a second main cylinder $A_2$. The engine 1 has a cylinder block 2 and a cylinder head 3, the latter being carried by the former, conventionally.

The cylinder block 2 has a pair of spaced cylinder bores 5 defining the first and the second cylinders $A_1$, $A_2$, within each of which a main piston 4 is slidably mounted for the known up and down reciprocation. The cylinder head 3 has a pair of internal hollow cavities serving as combustion chambers 6 formed correspondingly to the pair of cylinder bores 5.

Respectively at each of the cylinder areas $A_1$, $A_2$, a combination of an inlet port 7 and an exhaust port 8 are formed in the cylinder head 3, as will be hereinafter described in detail.

A sparking end 9*a* of a known spark plug 9, supported in the cylinder head 3, is exposed, preferably at center, into each of the pair of combustion chambers 6.

As illustrated in FIG. 1, each of the inlet and exhaust ports 7, 8 are formed in a side wall 12 (left side wall in the illustration) of the cylinder head, which extends substantially in parallel to a longitudinal center line 11 passing through the centers 10 of the cylinder bores 5 and extending in the same direction as that in which a crank shaft (not shown) of the engine 1 extends. Each combination of these ports 7, 8 pass through the wall 12 to open into the associated combustion chamber 6 at openings 7*a*, 8*a* which are located to the left of the center line 11. Each inlet port 7 is controlled by a known intake valve 13 provided at the opening 7*a*, while each exhaust port 8 is controlled by a known exhaust valve 14 provided at the opening 8*a*, as shown in FIGS. 2 and 3. These valves 13, 14 can be operated conventionally. Each combination of the ports 7, 8 are in a so-called counter-flow arrangement, wherein fuel-air mixture is fed into the combustion chamber 6 through the inlet port 7 formed in the left side wall 12 of the engine and, after combustion, it is discharged as counter-flow exhaust gas through the exhaust port 8 formed in the same side wall 12 of the engine.

Each of the cylinders $A_1$, $A_2$ is provided with a cooperating sub-cylinder 15 which is located to the right of the center line 11 as best shown in FIG. 1. In other words, each of the sub-cylinders 15 is located at the opposite side to the openings 7*a*, 8*a* of the inlet and exhaust ports 7, 8 with respect to the center line 11. Each sub-cylinder 15 opens at its lower end into the associated combustion chamber 6 and at its upper end into an upper chamber or space in the cylinder head 3. The upper end opening of the sub-cylinder 15 is closed by a closure member such as a cover plate 16. If desired, this closure member 16 may be formed integral with the cylinder head 3.

A sub-piston 17, carrying two or more conventional piston rings 18 on its circumference, is slidably mounted for reciprocation within each sub-cylinder 15, so that displacement of the sub-piston 17 can vary the clearance volume of the combustion chamber 6 and therefore the compression ratio of the engine. More particularly, as the sub-piston 17 axially moves toward the combustion chamber 6, the clearance volume of the chamber 6 is reduced for higher compression ratio, while, as the sub-piston 17 moves away from the combustion chamber 6, the clearance volume of the chamber 6 is increased for lower compression ratio. Incidentally, the sub-piston 17 is usually made of aluminium alloy, but a combustion engine side part or the entire body of the piston may be made of ceramics and/or other suitable material.

Between the top face of the sub-piston 17 and the inner wall of the closure member 16 there is formed a pressure oil (actuating oil) chamber 19 which is connected via a pressure oil feed passage 20 to a known pressure oil source (not shown). A control valve means, for example a check valve 21, is provided in the pressure oil feed passage 20, so that the passage 20 is closed upon pressure rise in the combustion chamber 6 during the compression or expansion strokes.

Figure 2A:
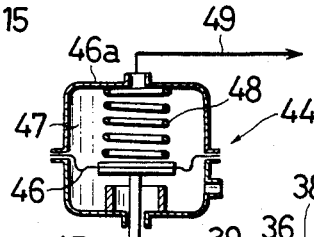
FIG. 2A is an enlarged cross section taken in the direction of arrows along line 2—2 of FIG. 1.
Figure 2B:
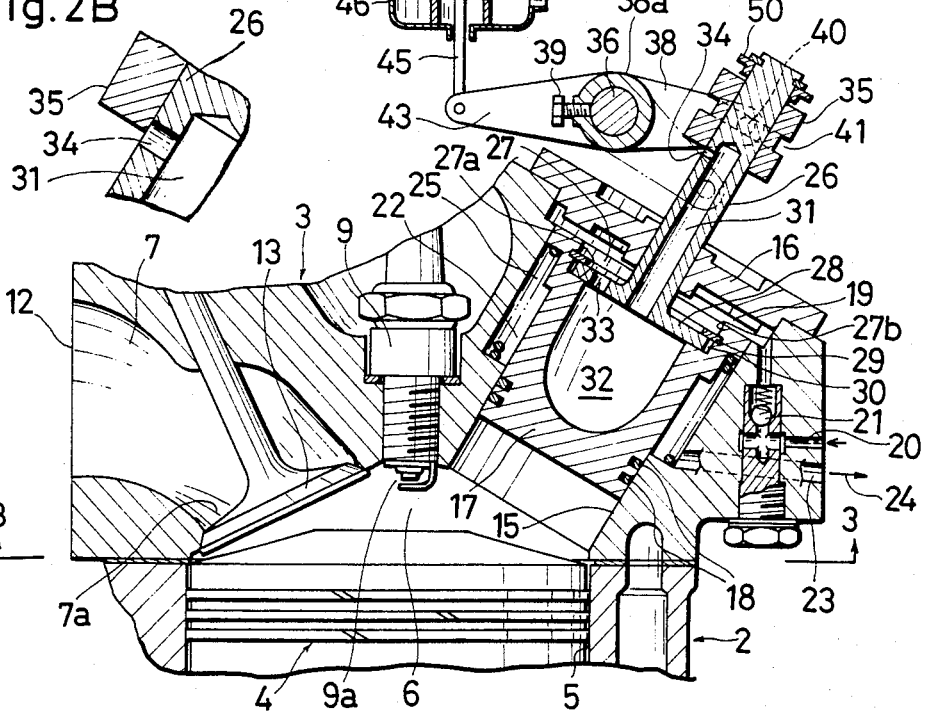
FIG. 2B is a detailed presentation of a part of FIG. 2A, in an enlarged scale, showing a spill port.
Figure 3:
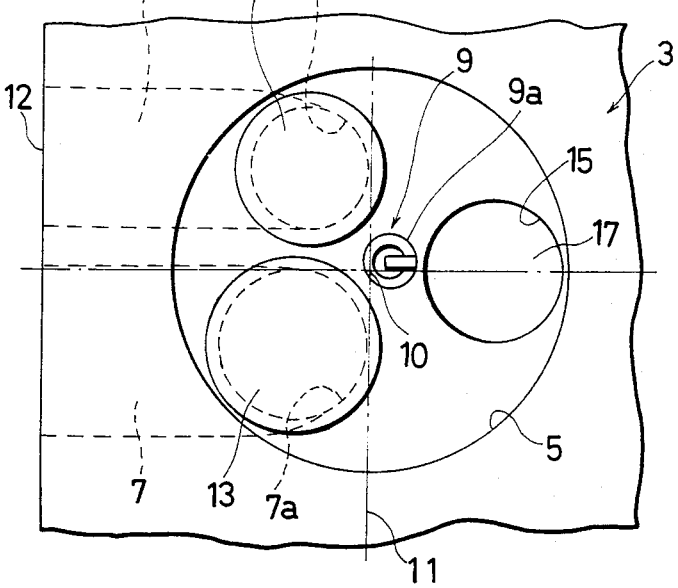
FIG. 3 is a fragmentary bottom plan view of a cylinder head taken in the direction of arrows along line 3—3 of FIG. 2A.

As shown in FIG. 2A, each of the sub-piston 17 is surrounded, in an axially limited range between the pressure oil chamber 19 and the uppermost piston ring 18, by an annular-shaped blow-by gas chamber 22 which can be provided by forming an annular recess in any one or both of the cylindrical walls of the sub-piston 17 and the sub-cylinder 15. Each of the blow-by gas chambers 22 is connected, via a port 23 formed in the cylinder head 3 and also a gas passage 24 communicating therewith, to a known blow-by gas treating means such as an intake air cleaner (not shown) of the engine or an intake manifold (not shown) to the engine.

Within the blow-by gas chamber 22 there is provided a coil spring 25 for normally urging the sub-piston 17 upwardly away from the combustion chamber 6.

As illustrated in FIG. 2A, the back end of each sub-piston 17 is formed with a short cylindrical recess 27 defined by an annular shoulder 27*a* and a short cylindrical inner wall surface 27*b*. A hollow, reciprocative member, such as a stem 26, extending coaxially of each sub-piston 17 through the disclosure member 16, is fixedly secured at its flanged front end to the back end of the sub-piston by means of a snap ring 29 or the like which can be adapted after the end flange 28 has been seated within the cylindrical recess 27 in abutment with the annular shoulder 27*a*. The diameter of the flange 28 is slightly smaller than that of the cylindrical recess 27 so as to provide a narrow annular clearance 30 between the cylindrical wall surface 27*b* and the circumference of the end flange 28, resulting in that stem 26 can be slightly moved transversely of the longitudinal axis of the sub-piston 17.

Each of the stems 26 extends through the associated closure member 16 in axially slidable manner. The stem is formed with an axial bore 31 of which the lower end opens into a cooling chamber 32 formed internally of each sub-piston 17. The cooling chamber 32 is communicated via a port 33 with the pressure oil chamber 19.

The upper section of the stem 26, projecting out of the closure member 16, is formed with a through hole 34, hereinafter referred to as "spill port", communicating with the axial bore 31, for the purpose of discharging the pressure oil (actuating oil) in the pressure oil chamber 19 into the known upper chamber or space formed internally of the cylinder head 3. A spilling regulation member, which may be for example in the form of a slidable ring 35, hereinafter referred to as "spill ring", is relatively slidably mounted on the stem 26 so that it can close the spill port 34 as the stem moves axially rearwardly while it opens the spill port as the stem moves axially forwardly.

As shown in FIG. 1, an interlocking shaft 36, which extends in the direction of row of the pair of main cylinders $A_1$, $A_2$, is supported on the upper side of the cylinder head 3 by the aid of a plurality of known bearing members 37 so as to be angularly movable about its own axis.

A pair of forked levers 38 are fixedly mounted at one end on the interlocking shaft 36, at the main cylinder areas $A_1$, $A_2$, as shown in FIG. 1. Each of the forked levers 38 may have a cylindrical base or boss 38*a* by means of which the lever is slidable supported on the shaft 36 and can be clamped thereto for co-rotation at an adjusted position by tightening a set screw 39 mounted in the base 38*a*.

As shown in FIGS. 1 and 2A, a pair of spaced free ends of each lever 38 may be provided with a pair of opposed pins 40 each extending inwardly into engagement with an annular groove 41 formed in the circumference of each of the spill rings 35, so that both of the spill rings 35 located at the main cylinder areas $A_1$, $A_2$, can be in simultaneous sliding motion along the stems 26 in accordance with the angular motion of the interlocking shaft 36.

In the above discribed construction, when the pressure in the pressure oil chamber 19, and therefore, that in the combustion chamber, becomes lower than that of the pressure oil source, the check valve 21 in the passage 20 takes its open position under the pressure from the pressure oil source, with the result that the actuating oil is fed into the chamber 19. When each of the spill rings 35 is axially moved from its solid line position down to the phantom line position in FIG. 2A, each of the spill ports 34 is closed and therefore the actuating oil release therefrom is interrupted for accumulation of the pressure oil in the chamber 19. In other words, as long as the pressure in the combustion chamber 6 is relatively low at the intake stroke or the expansion stroke, the actuating oil is continuously fed into and accumulated in the chamber 19 until the pressure therein is increased enough to force down the sub-piston 17 toward the combustion chamber 6 against the pressure in the chamber 6 which otherwise urges the sub-piston 17 rearwardly.

On the other hand, when the sub-piston 17 axially moves toward the combustion chamber 6 to permit the spill port 34 to be opened, the actuating oil is again released until the released oil volume from the spill port comes to a state of equilibrium with the supplied oil volume in the chamber 19. At this stage, because the force as developed by a pressure in the chamber 19 for urging the sub-piston 17 axially downwardly is in equilibrium with such a combined force as developed by a pressure in the combustion chamber 6 and also by a spring load of the coil spring 25 for urging the sub-piston axially upwardly, and thus, the forward movement of the sub-piston comes to end.

In contrast thereto, when each spill ring 35 is axially moved from its phantom line position up to the solid line position as shown in FIG. 2A, each spill port 34 takes its full open position to maximize the discharged oil volume therefrom. As a result, the pressure in the chamber 19 is decreased to permit the sub-piston 17 to move axially away from the combustion chamber 6 under pressure from the chamber 6 and also under spring action of the coil spring 25, until the spill port is again closed by the spill ring 35. Upon closure of the spill port, the discharged oil volume therethru is decreased to become balanced with the supplied oil volume in the chamber 19, with the result that the rearward movement of the sub-piston 17 comes to end. Thus, the axial movement of each of the sub-pistons 17 can be adjustably controlled by the axial sliding movement of the cooperating spill ring 35, and therefore, the compression ratio of the engine can be modified as desired.

In the case where an intense explosion pressure is exerted upon the sub-piston 17 at the expansion stroke and consequently the sub-piston is forced to move away from the combustion chamber to cause closure of the spill port 34, the actuating oil is confined within the pressure oil chamber 19 since the check valve 21 in the pressure oil feed passage 20 takes its closed position at this stage. Thus, the developed pressure in the chamber 19 can counteract against the intense explosion pressure. In this instance, the explosive impact upon the sub-piston 17 can be absorbed or buffered through discharge of the pressure oil before the closure of the spill port 34 and also the subsequent pressure increase in the chamber 19.

As best shown in FIG. 2A, the back end diameter of the sub-piston is larger than the front end diameter of the same. This particular construction of each sub-piston 17 provides such an advantage that the maximum increased pressure in the pressure oil chamber 19, produced by the expansion in the combustion chamber 6, can be lower than the maximum explosion pressure in the chamber 6 substantially in proportion to the difference between the back end face area and the front end face area of the sub-piston.

It should be noted that, according to the present invention, the intensely increased pressure in the pressure oil chamber 19, produced by the expansion in the combustion chamber 6, does not adversely affect the expected axial sliding movement of the spill rings 35.

According to the present invention, the pair of spill rings 35, arranged on the main cylinders $A_1$, $A_2$, are associated with the single interlocking shaft 36 via the forked levers 38, and therefore, the compression ratio at the main cylinder $A_1$, $A_2$ can be varied at the same time by angular movement of the single interlocking shaft 36. In this connection, if there exists, due to an error or errors in machining for instance, a certain difference in dimension and/or location between the spill port at the first cylinder area $A_1$ and that at the second cylinder area $A_2$, it cannot be expected to attain the simultaneous opening/closing functions of the pair of spill ports 34, and therefore the desired accurate control of the compression ratio in each of the main cylinders $A_1$, $A_2$ cannot be achieved.

A simple way to solve the above discussed problem is to properly adjust the positions of the pair of forked levers 38. More in detail, after unscrewing the set screws 39 for free axial sliding movement of each forked lever 38 along the interlocking shaft 36, the opening/closing positions of the pair of spill ports 34 at the cylinders $A_1$, $A_2$ should be accurately adjusted by sliding the pair of forked levers 38 to their relatively adjusted positions. Then, the forked levers 38 should be fixedly clamped at the adjusted positions by tightening the set screws 39.

Figure 5:
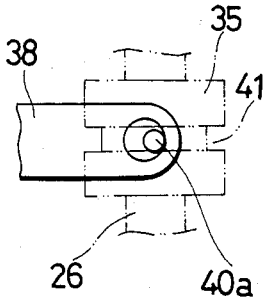
FIG. 5 is a schematic side elevation taken in the direction of arrows along line 5—5 of FIG. 4.
Figure 4:
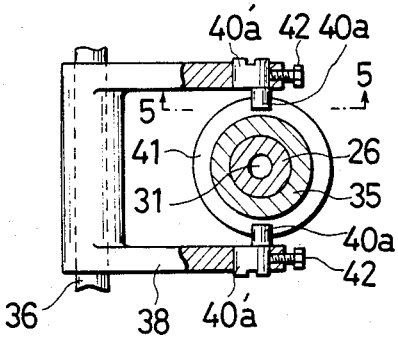
FIG. 4 is an enlarged, partially cut-away elevation showing operative engagement of a spill regulation member, in the form of a spill ring, with a cooperating forked lever.

The above positional adjustment may be made advantageously by utilizing eccentric pins **40*a* which are in engagement with the corresponding annular groove 41 of each spill ring 35, the center of each of the pins 40*a* being eccentric to that of its enlarged cylindrical base portion 40*a*' which is rotatably supported in each of the free ends of the forked levers 38, as illustrated in FIGS. 4 and 5. In the adjusting operation, after loosening each pair of set screws 42 which clamp the eccentric pins 40*a* in position, the relative opening/closing positions of the pair of spill ports 34 at the cylinder areas $A_1$, $A_2$ should be accurately adjusted by turning the pins 40*a* or their base portions 40*a*', so that the spill ports 34 can be opened or closed simultaneously. Finally, each of the pins 40*a* should be fixedly clamped at the adjusted positions by tightening the set screws 42**.

The interlocking shaft 36 is operatively connected to an appropriate actuator means via a linking arm 43 for desired limited angular movement about its own axis. In the embodiment as illustrated in FIGS. 1 and 2A, a diaphragm mechanism 44 is employed as the actuator. However, other types of actuators, for example an electrically operated actuator, may be utilized.

The diaphragm mechanism 44 has a diaphragm 46 operatively supported within a casing **46*a*, conventionally. An actuator rod 45 is connected at its inner end to the diaprhagm 46 and, at its outer end, extended out of the casing, to the linking arm 43 which is fixed at its one end to the interlocking shaft 36. In a diaphragm chamber 47, partitioned by the diaphragm 46, there is provided a coil spring 48 which normally urges the actuator rod 45** axially forwardly (downwardly in the illustration), as shown in FIG. 2A.

The diaphragm chamber 47 is communicated with a known intake manifold (not shown) of the engine via a conduit through which negative pressure (so-called "intake manifold vacuum"), produced in the inlet pipe, is introduced into the diaphragm chamber. Thus, when the negative pressure in the chamber 47 is increased (high manifold vacuum), the actuator rod 45 is forced to move axially rearwardly (upwardly) against the spring load of the coil spring 48 thereby to move both of the spill rings 35 toward the combustion chamber simultaneously.

In contrast thereto, when the negative pressure in the diaphragm chamber 47 is decreased (to atmospheric pressure), the actuator rod 45 is urged by the coil spring 48 so as to move axially forwardly (downwardly), thereby to force of the spill rings 35 to move away from the combustion chamber simultaneously. This retracting movement of the spill rings 35 is restricted for example by a snap ring 50 fixedly mounted on the back (upper) end of the stem 26.

As is well known, since the negative pressure (intake manifold vacuum) varies to an atmospheric pressure level in a stepless manner, generally in inverse proportion to loads upon the engine, as the engine load is increased. Accordingly, each compression ratio at the main cylinders $A_1$, $A_2$ falls down steplessly as the engine load is increased, while rises up steplessly as the engine load is decreased. Thus, the compression ratio can be automatically controlled in a smooth and stepless manner in accordance with increase in loads upon the engine.

When the engine is stopped, the manifold vacuum is varied to an atmospheric pressure level, and therefore, the pressure in the diaphragm chamber 47 also reaches the atmospheric level. Under such conditions, the coil spring 48 is allowed to push the actuator rod 45, so that each of the spill rings 35 is forced to move away from the combustion chamber 6 into engagement with the snap ring 50 mounted on the top of the associated stem 26. This results in that each stem 26, together with the cooperating sub-piston 17, is forcibly retracted by the further sliding movement of the spill ring 35 until the back end of the sub-piston 17 comes into contact with the closure member 16. Thus, upon the engine stop, each of the sub-pistons takes its extremely retracted position where the compression ratio is minimized. Consequently, at the time of subsequent starting of the engine, the minimum compression ratio is maintained until the engine gets into full operation to provide the sufficient manifold vacuum. Thus, according to the present invention, a low voltage at a spark plug is enough to start the engine. In other words, such a high voltage as otherwise required under a high compression ratio is no longer required for starting the engine. Further, according to the present invention, less torque is required for rotating a crankshaft at the time of cranking to start the engine.

Generally, the combustion chamber is so highly pressurized at the expansion stroke, that more or less portion of the produced combustion gas makes its exit, as blow-by gas, through a very narrow clearance formed between an internal circumference of a sub-cylinder and an external circumference of a sub-piston.

According to the present invention, the blow-by gas chamber is advantageously provided between the external circumference of the sub-piston 17 and the internal circumference of the subcylinder 15 at each of the main cylinder areas $A_1$, $A_2$, in communicating manner with the known blow-by gas treating means via the port 23 and the passage 24, as described hereinbefore. Thus, a portion of produced blow-by gas, which is directed toward the pressure oil chamber 19, is first introduced into the blow-by gas chamber 22 and then added into the known blow-by gas treating means. As a result, the blow-by gas flow into the pressure oil chamber 19 can be remarkably reduced and, therefore, undesirable leakage of the actuating oil from the chamber 19 into the combustion chamber 6 can be minimized, providing such specific advantages that deterioration of the pressure oil for actuating the sub-pistons 17 can be minimized and that undesirable confinement of the blow-by gas in the pressure oil chamber 19, which causes a hindrance to smooth reciprocation of the sub-piston, can be minimized.

In place of the mechanical type actuator 44 incorporated in the first embodiment of the invention as described in the foregoing, an electrically controlled actuator may be utilized. In this instance, it is possible to automatically control the variable compression ratio of the engine by such particular systems as shown in FIGS. 6 and 7.

Figure 6:
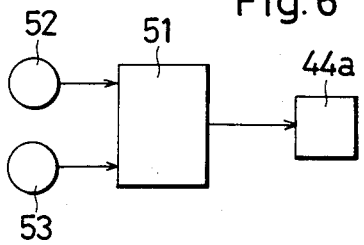
FIG. 6 is a block diagram showing one example of an automatic control system for controlling the variable compression ratio.

The automatic control system as diagramatically illustrated in FIG. 6 comprises an engine load detector 52 (intake manifold vacuum is available as engine load) and an engine speed detector 53, both of which are connected to an actuator control circuit 51 which controls operation of an electrically operated actuator **44*a* for effecting the movement of the spill rings. Thus, by inputting detected signals from the detectors 52, 53 to the circuit 51**, it is possible to automatically control the variable compression ratio of the engine, so that the ratio becomes steplessly lower as the engine load is increased while becomes steplessly higher as the engine speed is increased.

Figure 7:
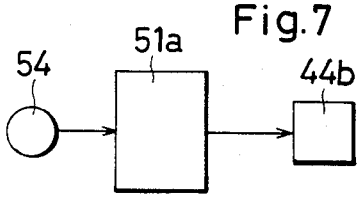
FIG. 7 is a block diagram showing another example of an automatic control system for the variable compression ratio.

The other example of the automatic control system as illustrated in FIG. 7 comprises a knocking sensor 54 connected to an actuator control circuit **51*a* which controls operation of an electrically operated actuator 44*b*** for effecting the movement of the spill rings. Thus, it is possible to automatically control the variable compression ratio so that the engine has a relatively high compression ratio when knocking does not occur while it has a relatively low compression ratio when knocking occurs.

In the automatic control of the variable compression ratio, the above described actuator arrangement, which permits simultaneous variations of the relative compression ratios of the pair of main cylinders by the single common actuator, provides such advantages that less space is required as compared to the instance where an individual actuator is provided per each of the main cylinders, and that error or difference in compression properties inherent to each of the main cylinders can be minimized.

On the other hand, knocking in the engine is likely to be caused for instance by high temperature in the engine, high temperature in the intake air, low humidity in the intake air, and/or high atmospheric pressure. Therefore, in order to automatically control the compression ratio in response to variable operating conditions, such as for example, variable engine loads, variable engine speeds, occurrences of knocking, it is desirable to take into consideration, for compensatory adjustment of the compression ratio control, such external factors as, for example, temperature in the engine, temperature and humidity in the intake air, and/or degree of the atmospheric pressure. For instance, when the engine temperature becomes higher, such adjustment in the compression ratio control should be made to lower the compression ratio.

For the automatic control of the compression ratio, it is obviously recommendable to additionally provide such auxiliary controls as for regulating the actuating oil supply into the pressure oil chamber or regulating the operating speed of a throttle valve, at acceleration and/or at deceleration of the engine. It is also possible to add such a control for regulating ignition timing in accordance with variation of the compression ratio. Further, it is also obviously possible to conduct the above discussed automatic control under variable operating conditions of the engine by utilizing a micro-computer system, optimally totalizing all the factors including the added external ones such as knocking, acceleration and/or deceleration of the engine and/or ignition timing.

Further, in the arrangement of the cylinder head 3 provided with the spark plugs 9 and the inlet and exhaust ports 7, 8 together with the sub-pistons 15 for varying the clearance volume of the engine 1, each of the spark plugs 9 is located substantially in the center 10 of the associated cylinder bore 5, as shown in FIG. 1. The openings 7*a*, 8*a* of the inlet and exhaust ports 7, 8 are located on one side (left side in FIG. 1) to the center line 11, while the sub-cylinders 15 are on the opposite side (right side) thereto. More particularly, each of the spark plugs 9 is, when viewed from top, located substantially in the center of the combustion chamber 6 which defines the openings 7*a*, 8*a* of the ports 7, 8 and also the lower extremity of the sub-cylinder 15, the extremity being near the sparking end 9*a* of the spark plug.

According to this arrangement, it is possible to spread the effect of ignition by the spark plug 9 into the whole combustion chamber 6 and also to the sub-cylinder 15, quite positively, whereby combustion of fuel-air mixture is considerably accelerated.

Further, as a particular advantage obtained by the arrangement wherein the inlet and exhaust ports 7, 8 are located on one side to the longitudinal center line 11 (FIG. 1) while the subcylinders 15, together with the cooperating sub-cylinders 15, are on the other side to the same center line, it is possible to allocate the valve-operating mechanism (known itself and not shown here) for the intake and the exhaust valves 13, 14 to one side of the center line 11 while the sub-piston reciprocating mechanism, including the movable stems 26, the spill regulation members 35 and the levers 38, to the opposite side, whereby ease and convenience in design, manufacture, assembly, inspection, and maintenance are obtained.

Figure 8:
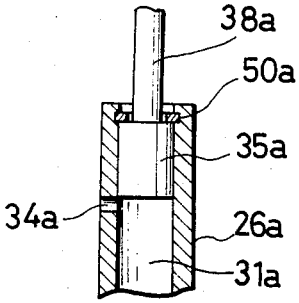
FIG. 8 is a fragmentary sectional elevation showing a modification of the spill regulation member and a cooperating spill port.

FIG. 8 illustrates another embodiment of a spill regulation mechanism which includes a cylindrical slider 35*a*, hereinafter referred to as "spill bar", which is axially slidably mounted within a hollow stem 26*a* having an axial bore 31*a*, serving as an oil passage, which is communicated with the pressure oil chamber 19 in the same manner as described hereinbefore. A snap ring 50*a* is mounted internally of the back end (upper end) of the stem 26*a* which restricts the retracting (upward) movement of the spill bar 35*a*.

The spill bar 35*a* may be operatively connected, via its connecting rod 38*a*, to an appropriate actuator means, such as described in the foregoing, so as to axially slide back and forth within the bore 31*a* in response to the variable operating conditions of the engine. When the spill bar 35*a* takes its most retracted position (rearmost position), the stem 26*a* and hence the sub-piston 17, are moved to their most retracted positions where the compression ratio is minimum.

Figure 9:
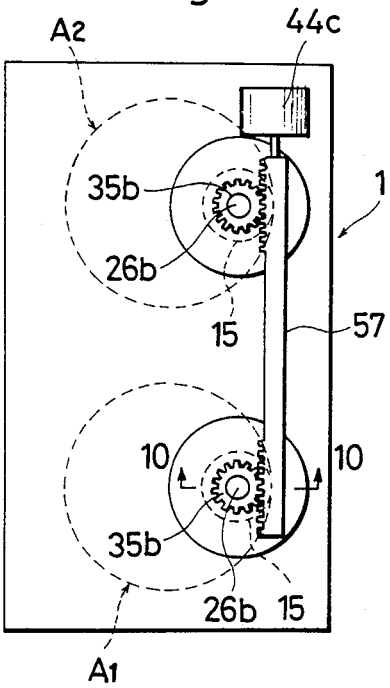
FIG. 9 is a similar view to that of FIG. 1, showing another embodiment of the system according to the present invention incorporated in the two-cylinder engine.
Figure 11:
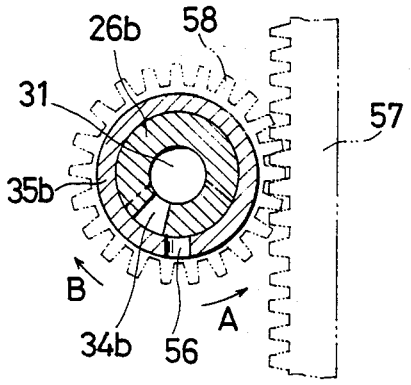
FIG. 11 is a cross section taken in the direction of arrows along line 11—11 of FIG. 10.
Figure 10:
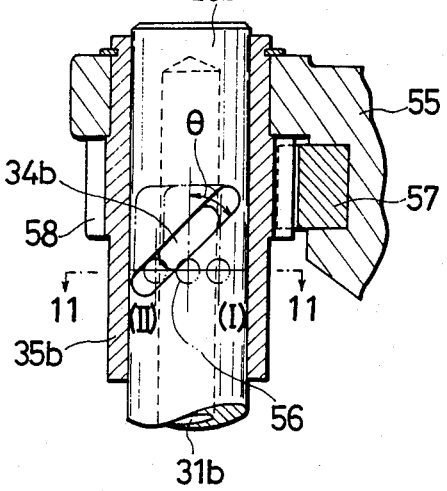
FIG. 10 is an enlarged fragmentary section taken in the direction of arrows line 10—10 of FIG. 9.

FIGS. 9 thru 11 illustrate a further embodiment of the spill regulation mechanism which includes a ring gear type spill ring 35*b* and an axially movable but non-rotatable stem 26*b* having an axial bore 31*b* and a slot-shaped spill port 34 formed therein, the bore 31*b* and the spill port 34 being in communication with each other to provide the passage for the actuating oil (pressure oil).

The spill ring 35*b* is supported on the cylinder head 3 by the aid of a support bracket 55 so as to be rotatable about the axis of the stem 26*b*, which extends through both of the spill ring 35*b* and the bracket 55 in relatively slidable relation therewith.

The stem 26*b* is formed, in proper position, with a slot-shaped spill port 34*b* whose longitudinal axis is inclined with respect to that of the stem by a certain angle $\theta$ as shown in FIG. 10. The spill ring 35*b* is formed with a release port 56 which cooperates with the spill port 34*b* to permit the release of the actuating oil therethru when the port 56 is overlapped with the spill port 34*b* along with rotational motion of the spill ring 35*b* as well as the back and forth sliding motion of the stem 26*b*.

The ring gear type spill ring 35*b* having teeth 58 is in mesh with a movable rack 57 which is provided on the cylinder head 3 and extends in the direction of row of the pair of main cylinders $A_1$, $A_2$. The rack may be supported on the spaced brackets 55 so as to be driven into back and forth motion by an appropriate actuator 44*c* arranged in position on the cylinder head 3, in order that the pair of toothed spill rings 35 are rotated in the direction of the arrow A or B (FIG. 11) in response to the variable operating conditions of the engine, such as variable loads on the engine, as described in the foregoing.

In operation, when the spill ring 35*b* is rotated, the relative position of the release port 56 to the inclined slot or spill port 34*b* can be varied to a position I or II (FIG. 10), whereby the spill port 34*b* can be opened or closed accordingly.

In the above described spill regulation mechanism, the rack 57 may be replaced with a link mechanism or other suitable driving mechanism adapted to drive the spill rings 35*b* simultaneously. Further, such a spill port as substantially similar to the illustrated one 34*b* may be formed in the spill ring 35*b*, while such a release port as substantially similar to the illustrated one 56 may be formed in the stem 26*b*. It is apparent that configurations of the spill port 34*b* and the release port 56 may be varied as desired, for example as shown in phantom lines in FIG. 10.

Figure 13:
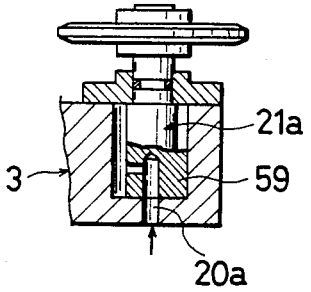
FIG. 13 is a fragmentary cross section taken in the direction of arrows along line 13—13 of FIG. 12.
Figure 12:
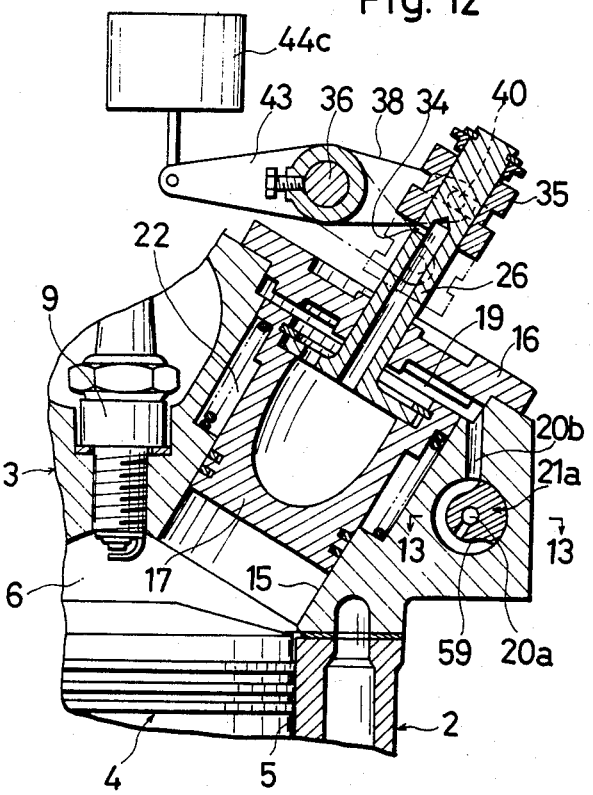
FIG. 12 is a similar view to that of FIG. 2A, showing a further embodiment of the system according to the present invention, in which a rotary valve is employed for controlling a pressure oil feed passage.

The check valve 21 to be provided in the pressure oil passage 20, as described hereinafter, may be replaced with such a valve of the type, for example a rotary valve as illustrated in FIGS. 12 and 13, that automatically changes its positions in response to operating conditions of the engine, so that it takes its closed position during such periods of piston strokes when the pressure in the combustion engine is increased.

In FIGS. 12 and 13, there is illustrated a rotary valve 21*a* as one example of the above type of valve available for the invention. The rotary valve 21*a* has a valve body 59 so arranged as to operate in response to the rotational movement of a crankshaft (not shown) of the engine, in such a particular manner that it makes its one rotation per two rotations of the crankshaft. In this manner, it is possible to close pressure oil feed passages 20*a*, 20*b* during period of time from midway to termination of one compression stroke where pressure in the combustion engine is increased, while the passages 20*a*, 20*b* are opened in the other period of time of the piston strokes.

In case where the check valve 21 is employed for controlling the pressure oil feed passage 20, it may be presumed that the open/close property of the valve is deteriorated at the high speed zone of the engine. However, by utilizing the rotary valve 21*a* as adapted to be operated in response to the engine speed, high operational reliability is obtained, whereby the pressure oil is prevented from flowing back to the pressure oil source.

Incidentally, the rotary valve 21*a* may be replaced by such a type of valve as can be actuated by a rotary cam or the like.

As the actuating oil to be supplied to the pressure oil chamber 19, it is possible to utilize such oils as, for example, lubricating oil for the engine, actuating oil for power-steering mechanism or that for automatic transmission. In a particular case where the lubricating oil for the engine is employed as the actuating oil in question, the structure for the oil supply can be quite simplified by the arrangement wherein the lubricating oil, serving as the actuating oil, from the lubricating oil pump is introduced into the passages 21 or 21*a* leading to a main gallery for distributing the oil to various parts of the engine, while the released oil from the spill port of the stem is released into the upper chamber or space of the cylinder head so as to be returned into an oil pan (not shown) located at the lower part of the cylinder block 2, together with lubricating oil for the valve-operating mechanism (not shown), which is generally provided within the upper chamber of the cylinder head.

Figure 14:
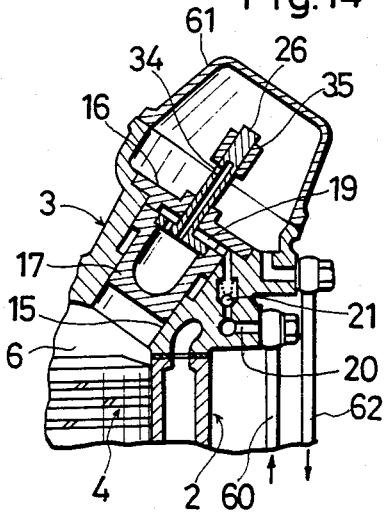
FIG. 14 is a reduced section similar to that of FIG. 12, showing a still further embodiment of the system according to the present invention, which is designed so that such oils as used for actuating the power steering mechanism, the automatic transmission or other equipped device or mechanism is utilized as an actuating oil for the system of the invention.

On the other hand, in order to utilize the actuating oil for the power steering mechanism or that for the automatic transmission, the following arrangement as illustrated in FIG. 14 may be utilized, in which a branched passage 60, extended from an actuating oil pump for the steering mechanism or transmission, is connected to the pressure oil feed passage 20 leading to the pressure oil chamber, while the released oil from the spill port 34 is introduced into a hollow space formed within a cover 61, provided externally of the closure member 16 for covering the spill regulation member 35 and the stem 26, and then returned into an oil sump (not shown) of the power steering mechanism or that of the automatic transmission.

Further, it will be easily understood that the variable compression system for internal combustion engines according to the present invention can be readily applied, individually or in combination, to other types of engines differing from the type as illustrated and described above as one example of such applications in an unlimitative sense, by applying current knowledge.

The present invention being thus described, it will be obvious that same may be varied in many ways. Such variations are not to be regarded as a departure from the spirit and scope of the invention, and all such modifications as would be obvious to one skilled in the art are intended to be included within the scope of the following claims.

We claim:

1. A variable compression system for internal combustion engines comprising:

at least one main cylinder communicating with a cooperating combustion chamber having a clearance volume which is adjustable by hydraulic regulation of back and forth movement of a sub-piston slidably mounted within a housing containing a sub-cylinder which communicates with said combustion chamber, spring means for normally urging said sub-piston away from said combustion chamber, a pressure oil chamber formed on a back face of said sub-piston and pressurized from a pressure source, a control valve for controlling supply of pressure oil, serving as actuating oil, to said pressure oil chamber, said control valve being closed when pressure rise occurs in said pressure oil chamber, a reciprocative member connected at one end to said sub-piston and having a portion projecting out of said housing containing said sub-cylinder, said reciprocative member having an internal oil passage which communicates with said pressure oil chamber, a spill port formed in said reciprocative member where said portion projects out of said housing containing said sub-cylinder, communicated with said internal oil passage for releasing therethrough said actuating oil introduced from said pressure oil chamber into said internal oil passage, a spill regulation member slidably mounted on said reciprocative member where said portion projects out of said housing containing said sub-cylinder, so as to close said spill port when said sub-piston moves away from said combustion chamber and open said spill port when said sub-piston moves toward said combustion chamber, and means for operating said spill regulation member being located outside of said housing.

2. The system as defined in claim 1, wherein said control valve is a check valve.

3. The system as defined in claim 1, wherein said reciprocative member is in the form of a stem which is movable back and forth co-axially with said sub-piston.

4. The system as defined in claim 1, wherein said reciprocating member is a stem and said spill regulation member is a spill ring mounted on an external circumference of said stem, so as to slide back and forth in a direction of a longitudinal axis of said stem.

5. The system as defined in claim 1, wherein said reciprocating member is a stem and said spill regulation member is a spill ring said spill ring is a spill bar disposed within said internal oil passage of said stem so as to be relatively slidable back and forth in a direction of an axis of said stem.

6. The system as defined in claim 1, wherein said reciprocating member is a stem and said spill regulation member is a rotatable ring relatively slidably mounted on said part of said stem so as to be angularly movable about said axis of said stem within a predetermined range of angles, said rotatable ring being formed with a slot-shaped release port whose longitudinal axis is substantially inclined by a predetermined angle with relative to said axis of said stem, and said stem is formed with said spill port which cooperates with said slot-shaped release port to permit release of said actuating oil therethrough when it is overlapped with said slot-shaped release port.

7. The system as defined in claim 1, and further comprises a blow-by gas chamber formed between an external circumference of said sub-piston and an internal circumferen of said sub-cylinder so as to surround said sub-piston.

8. The system as defined in claim 1, wherein said spill regulation member is connected to said means for operating said spill member so as to be actuated thereby automatically in response to variable operating conditions of said engine.

9. The system as defined in claim 1, wherein when said engine is stopped said spill regulation member is actuated in such a manner that said sub-piston is retracted to provide a minimum compression ratio.

10. The system as defined in claim 1 that includes at least one combustion chamber, a spark plug disposed, when viewed from above, substantially in a center of said combustion chamber, an inlet port having its opening into said combustion chamber, an exhaust port having its opening into said combustion chamber, both of said openings being located on one side of a center line which, when viewed from above, passes through said center of said combustion chamber and extends substantially in parallel with a longitudinal axis of said engine as extending substantially parallel with an axis of a crankshaft of said engine, wherein said sub-cylinder opens into said combustion chamber on an opposite side to said one side of said center line.

11. The system as defined in claim 1 that includes at least two main cylinders, wherein at least two spill regulation members are provided for cooperation with said at least two main cylinders, and said at least two spill regulation members are interconnected together so that they are simultaneously actuated.

12. The system as defined in claim 1, wherein said control valve is of such a type that automatically changes its positions in response to operating conditons of said engine, so that it takes its closed position during such periods of piston strokes when pressure rise occurs in said combustion chamber.

13. The system as defined in claimed 12, wherein said control valve is a rotary valve.

14. The system as defined in claim 1, wherein said reciprocating member is a stem and said spill port is a slot-shaped one whose longitudinal axis is substantially inclined by a predetermined angle with relative to said axis of said stem, and said spill regulation member is a rotatable ring relatively slidably mounted on said part of said stem so as to be angularly movable about said axis of said stem within a predetermined range of angles, said rotatable ring being formed with a release port which cooperates with said slot-shaped spill port to permit release of said actuating oil therethrough when it is overlapped with said slot-shaped spill port.

15. The system as defined in claim 14, wherein said rotatable ring is a gear ring which is driven by a reciprocating rack.

* * * * *

UNITED STATES PATENT AND TRADEMARK OFFICE

CERTIFICATE OF CORRECTION

PATENT NO. : 4,516,537

DATED : May 14, 1985

INVENTOR(S) : Mitsuharu NAKAHARA et al

It is certified that error appears in the above-identified patent and that said Letters Patent is hereby corrected as shown below:

IN THE HEADING OF THE PATENT:

Add Section [30] Foreign Applicatin Priority data:

--Mar. 24, 1982 [JP] Japan.....57-48294
Apr. 19, 1982 [JP] Japan.....57-66115
May 12, 1982 [JP] Japan.....57-80526
May 12, 1982 [JP] Japan.....57-80528
May 12, 1982 [JP] Japan.....57-80531
Aug. 31, 1982 [JP] Japan.....57-151944--

Signed and Sealed this

*Thirteenth* Day of *August 1985*

[SEAL]

*Attest:*

DONALD J. QUIGG

*Attesting Officer*

*Acting Commissioner of Patents and Trademarks*